United States Patent [19]

Quam

[11] Patent Number: 4,596,440

[45] Date of Patent: Jun. 24, 1986

[54] ELECTRICAL PROBE CONTACT

[75] Inventor: Grant S. Quam, Owatonna, Minn.

[73] Assignee: E. F. Johnson Company, Waseca, Minn.

[21] Appl. No.: 586,797

[22] Filed: Mar. 6, 1984

[51] Int. Cl.[4] ..... H01R 4/10; H01R 11/18

[52] U.S. Cl. ..... 339/276 R; 339/252 P

[58] Field of Search ..... 339/223, 252 P, 276 R, 339/276 F, 276 SF, 276 T

[56] References Cited

U.S. PATENT DOCUMENTS

| | | | |
|---|---|---|---|
| 2,802,194 | 8/1957 | Kirk | 339/276 SF |
| 2,983,892 | 5/1961 | Williams et al. | 339/252 P |
| 3,277,422 | 10/1966 | Shevlin | 339/252 P X |
| 3,718,750 | 2/1973 | Sayers | 339/276 R X |
| 3,941,449 | 3/1976 | Baumanis | 339/252 P X |
| 4,415,223 | 11/1983 | Asick | 339/276 R |

FOREIGN PATENT DOCUMENTS

| | | | |
|---|---|---|---|
| 1375854 | 11/1974 | United Kingdom | 339/252 P |

*Primary Examiner*—Eugene F. Desmond

*Attorney, Agent, or Firm*—Dorsey & Whitney

[57] ABSTRACT

An easy to manufacture, yet durable electrical probe contact is provided which is especially designed for connecting test equipment leads and patch cords to a variety of probe tips. The contact hereof includes a stamped and formed coupling portion that electrically and mechanically couples a wire lead to a screw machined or cold pressed probe tip. The manufacturing advantages inherent in stamped and formed contacts are thereby combined with the durability of screw machined and cold pressed tips. Moreover, the coupling portion is especially designed to receive a variety of tips, including the desirable banana plug type tip.

2 Claims, 11 Drawing Figures

ELECTRICAL PROBE CONTACT

BACKGROUND OF THE INVENTION

1. Field of the Invention

The present invention relates to electrical probe contacts for electrical wires and similar conductors. More particularly, the invention relates to a unique electrical probe contact having a stamped and formed sheet metal coupling portion that can receive a variety of screw machined or cold formed tips or probes.

2. Background Art

Electrical probe contacts are commonly one of two types. The first type, exemplified by U.S. Pat. No. 4,169,154 to Plyler, are stamped and formed from a sheet metal blank. Such contacts have a sheet metal tip portion for insertion into various electrical equipment and a sheet metal rear portion having U-shaped crimp sections for grasping both the conductor and the insulation of an electrical wire. The second type of electrical probe contact are formed by a standard screw machine process. Such contacts often have a tip portion, comprising a banana plug tip wherein the supporting center pin of the tip is screw machined, and an integral screw machined rear portion to which an electrical conductor is soldered.

Contacts formed from sheet metal are easily and cheaply manufactured. It has heretofore not been possible, however, to stamp a sheet metal contact that is adaptable to receive a variety of probe tips. In particular, there are no sheet metal contacts that can readily receive a banana plug tip having a supporting center pin. Screw machined contacts can easily accommodate the desirable banana plug tip, but the screw machining process is significantly more involved and expensive than the stamping of contacts from sheet metal strips. Moreover, the usual practice of soldering wire to the screw machined contact significantly slows down the manufacturing process.

An electrical contact that included a stamped and formed sheet metal coupling portion having crimp sections, that could be crimped to an electrical wire instead of soldered and, most importantly, that could be used in conjunction with a variety of tips, including the desirable banana plug tip, would be a decided advantage.

SUMMARY OF THE INVENTION

The present invention meets the need for a low cost, versatile electrical contact that includes a stamped and formed body portion adaptable to receive a variety of durable screw machined, or cold formed tips.

The electrical contact hereof broadly includes an elongated body comprised of two parts. The first part is a sheet metal coupling portion having crimping arms that secure an electrical wire, and the insulation surrounding the wire, to the body portion, and separate, interlocking arms that secure the second part, a screw-machined or cold formed tip section, to the body portion. The coupling portion assures electrical and mechanical contact between the electrical wire and a variety of screw machined or cold formed tips, the tips being the parts that ultimately make contact with the intended electrical machine or device.

The disclosed electrical contact, the result of both sheet metal and screw machining or cold forming processes, is well suited to efficient large quantity production. The sheet metal coupling portions can be stamped from a continuous strip of sheet metal thereby enhancing mass production manufacturing techniques. Furthermore, soldering is completely eliminated from the assembly process.

DESCRIPTION OF THE PREFERRED EMBODIMENT

Figure 1:
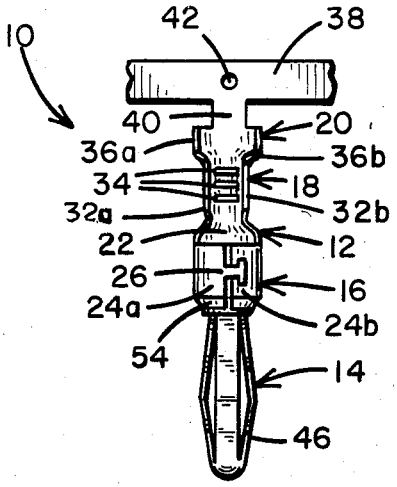
FIG. 1 is a front elevational view of an electrical contact constructed in accordance with the present invention.

An electrical probe contact 10 in accordance with the present invention broadly includes a coupling portion 12 and a tip portion 14. The coupling portion 12 comprises a tip receiving section 16, conductor crimp section 18, and insulation crimp section 20. The individual sections 16, 18, 20 are integrally connected along a center strip 22.

The tip receiving section 16 comprises a pair of opposed arms 24*a*, 24*b* extending outwardly from the center strip 22. One of the arms 24*a*, includes a "T" shaped key 26 at the outermost lateral edge thereof. A complementary key way 28 is defined by the outermost lateral edge of opposed arm, 24*b*. Tip receiving section 16 further includes centered alignment aperture 30 for alignment of the section 16 within a stamping and forming tool.

The conductor crimp section 18 comprises a pair of opposed arms 32*a*, 32*b* extending outwardly from the center strip 22. Each conductor crimp section arm 32*a*, 32*b* is spaced apart from its adjacent tip receiving arm 24*a*, 24*b* by a portion of the center strip 22. The conductor crimp section 18 includes three, generally parallel, inwardly protruding strength ribs 34 stamped into the center strip 22.

The insulation crimp section 20 comprises a pair of arms 36*a*, 36*b* extending outwardly from the center strip 22. Each arm 36*a*, 36*b* is spaced apart from its adjacent conductor crimp section arm 32*a*, 32*b* by a portion of center strip 22.

Figure 6:
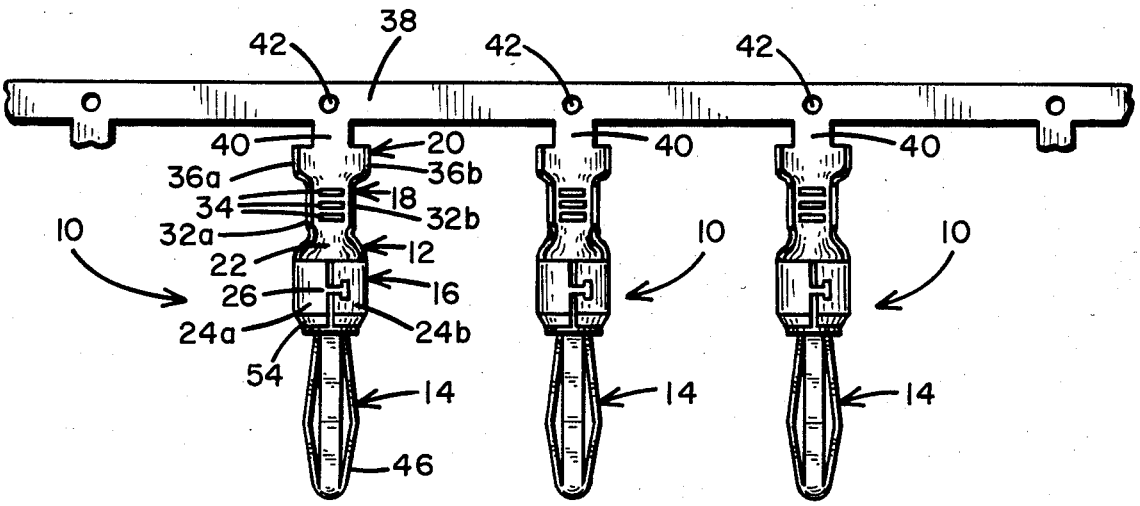
FIG. 6 is a front elevational view of a plurality of electrical contacts in accordance with the present invention prior to detachment from a continuous carrier production strip.
Figure 4:
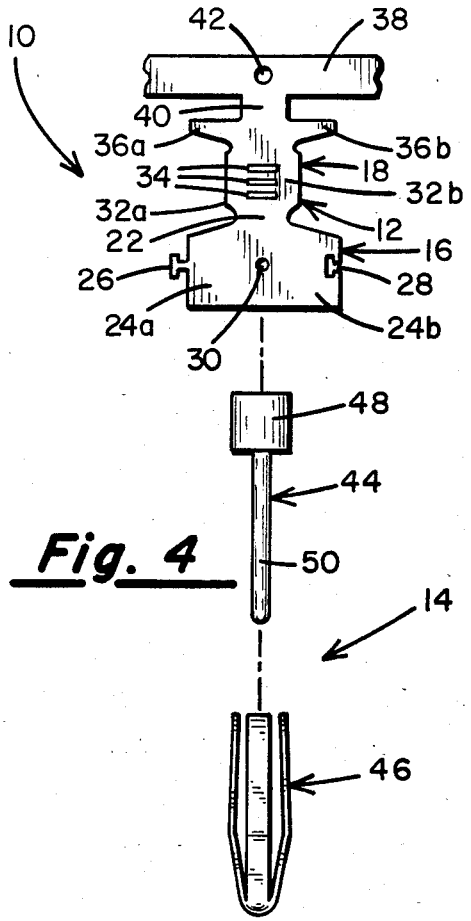
FIG. 4 is an exploded view of an electrical contact in accordance with the present invention.

It will be understood that each coupling portion 12 may be stamped as a discrete unit. A plurality of coupling portions 12, however, may be stamped in a single piece of sheet metal so as to remain on a single carrier strip 38, as depicted in FIG. 6. Each individual coupling portion 12 may be integrally connected to the carrier strip 38 by an extension 40 of its center strip 22. Positioning apertures 42 may be placed in the strip 38 longitudinally in line with the center strip 22 of each coupling portion 12.

Figure 2:
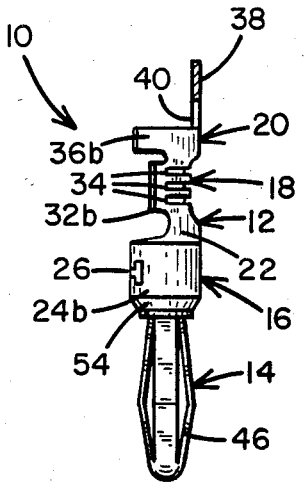
FIG. 2 is a side elevational view of an electrical contact in accordance with the present invention.
Figure 3:
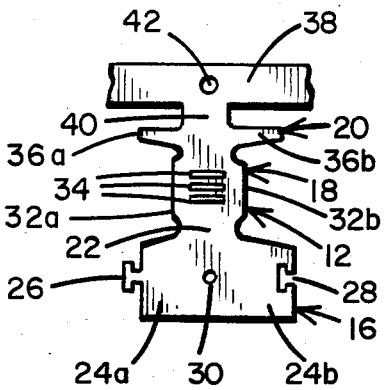
FIG. 3 is a view of an unfolded coupling portion of an electrical contact in accordance with the present invention.

The coupling portion 12 is initially formed as a generally planar unit. Prior to assembly of the coupling portion 12 to the tip portion 14, the conductor and insulation crimp sections 18, 20 are bent to form U-shaped channels, and the tip receiving section 16 is formed into a tube shaped receptacle with key 26 received within key way 28. Moreover, as best depicted in FIG. 2, the conductor crimp section 18 is pressed inwardly relative to the tip receiving and insulation crimp section 16, 20.

In the preferred embodiment, the tip portion 14 comprises a center support pin 44, and a sheet metal banana spring 46, to form a banana plug tip. The center support pin 44 may be screw machined or cold formed, and includes a base section 48 and probe section 50.

Figure 5:
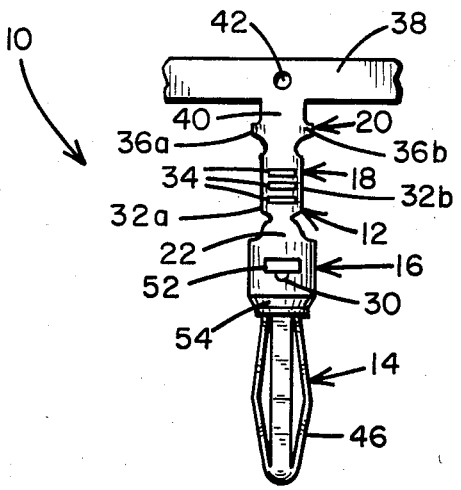
FIG. 5 is a rear elevational view of a electrical contact in accordance with the present invention.
Figure 11:
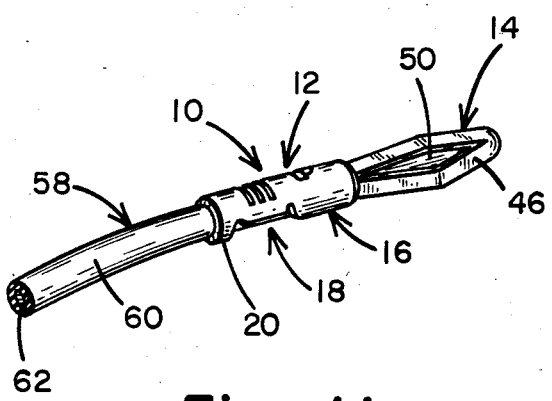
FIG. 11 is a perspective view of an electrical probe contact in accordance with the present invention fully assembled with an electrical lead.

The process for attaching the tip portion 14 to the coupling portion 12 will now be described. The center support pin 44 and banana plug spring 46 are first inserted into the tube formed by the tip receiving section 16 of the coupling portion 12. The support pin 44 is staked within the tip receiving section 16 by indenting the rear of the tip receiving section 16. The staking process produces a rectangular staking indentation 52. The resulting indentation 52, as depicted in FIG. 5, is made near the centered aperture 30, to facilitate inward bending of the tip receiving section 16.

Next, the tip receiving section 16 is swaged to capture the banana spring 46 between the tip receiving section of the coupling portion 12 and the center support pin 44. The swaging operation produces a frustoconical portion 54 on the tip receiving section 16.

As depicted in FIG. 6, the above described operations may be performed while the coupling portion 12 remains attached to the carrier strip 38. The arrangement of the assembled contacts 10 on a carrier strip 38 facilitates storage of the contacts 10, for instance, in a coil configuration. More importantly, the arrangement of the contacts 10 along a carrier strip 38 facilitates mass production manufacturing techniques in the attachment of wire leads to the electrical contacts 10.

An electrical conductor 58 may be attached to the contact 10, and in particular, to the conductor and insulation crimp sections 18, 20, by means of the following steps. First, insulation 60 surrounding the conductor wire 62 is stripped back to expose the wire 62 therein. Second, the conductor 58 is laid in the coupling portion 12 with the exposed wire 62 adjacent the conductor crimp section 18, and the insulation 60 adjacent the insulation crimp section 20. The arms **36*a*, 36*b* and arms 32*a*, 32*b* are crimped into contact with the insulation 60 and wire 62 respectively such that the wire is mechanically and electrically secured to the coupling portion 12. In this regard, it will be appreciated that the ribs 34, in addition to providing the coupling portion 12 as added strength, frictionally abut the electrical conductor to aid in the mechanical attachment of the wire to the coupling portion 12. Moreover, the indented relationship of the conductor crimp section 18 relative to the insulation crimp section 20 (see FIG. 2) provides for complete grasping of the conductor and insulation portions of the lead, notwithstanding their different respective diameters. The individual electrical contacts 10 can be severed from the carrier strip 38** either before or after attachment of the electrical wire. The above described process can be carried out fully by automated machinery.

Figure 7:
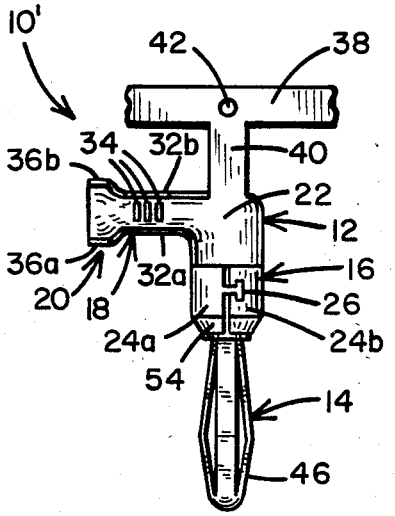
FIG. 7 is a front elevational view of a second embodiment of the present invention.
Figure 8:
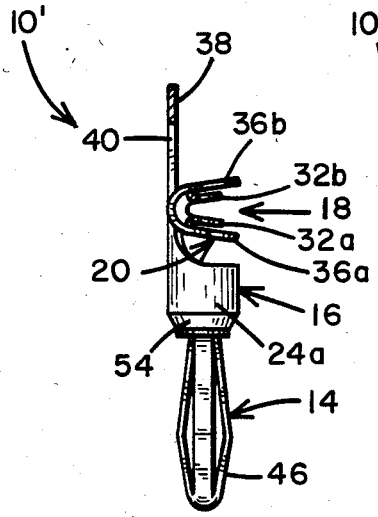
FIG. 8 is a side elevational view of the electrical contact depicted in FIG. 7.

Referring now to FIGS. 7 and 8, an alternative embodiment of the electrical contact 10' will now be described. The alternative embodiment depicted in FIGS. 7 and 8 is similar to the above described preferred embodiment in all respects except that the center strip **22*a* in the alternative embodiment includes a 90° angle between the conductor crimp section 18 and the tip receiving section 16. Elements of the embodiment 10', therefore, that are similar to the elements described above in conjunction with the preferred embodiment, are notated with similar numerals. It will be appreciated that the angle between the tip receiving sections 16 and conductor crimp section 18 of the contact 10'** can be varied from 180°, or in line, to any preferred angle. The proper angle, therefore, can be manufactured for a particular application.

Figure 9:
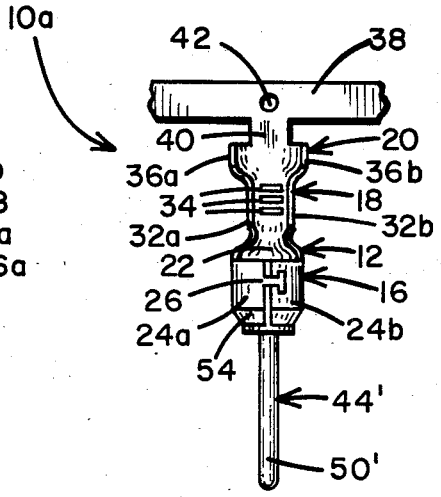
FIG. 9 is a front elevational view of an electrical contact in accordance with the first embodiment of the present invention but including an alternative tip section.
Figure 10:
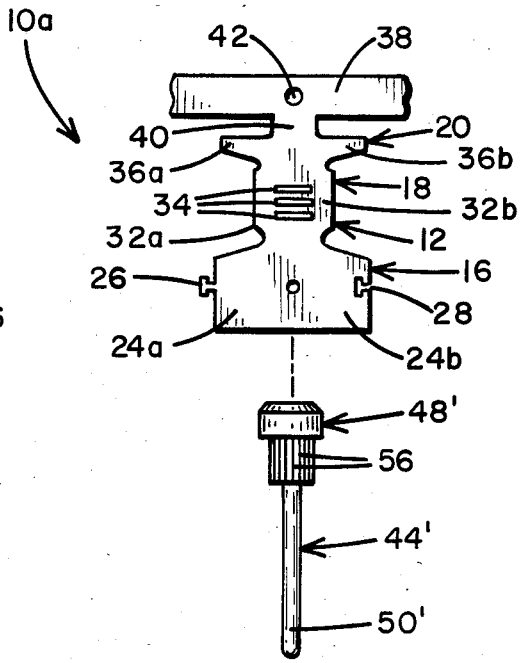
FIG. 10 is an exploded view of the contact depicted in FIG. 9.

Referring to FIGS. 9 and 10, an electrical contact **10*a* in accordance with the present invention is depicted having a coupling portion 12 connected to a tip portion 14' different from that described above. It will be appreciated that the tip portion 14' comprises a probe 44' similar to the center support pin 44 described above. The probe 44' has a base section 48' and probe section 50' extending therefrom. The base section 48' includes a stepped portion 56 that has a plurality of axially oriented grooves 56 to facilitate mechanical securement of the base section 48' within the tip receiving section 16 of the coupling portion 12. The stepped portion 56 is included to enable assembly of both banana plugs and tip plugs on the same swaging tool. That is to say, the stepped portion 56 presents approximately the same outer diameter as the center pin 44 and banana spring 46 in combination, such that the frustoconical portion 54 is swaged to the same inner diameter on both the banana plug and tip plug embodiments of the probe contact 10**.

I claim:

1. A stamped and formed sheet metal probe contact for an electrically conducting lead including an outer insulating cover carried by an inner electrical conductor, said cover defining an insulating cover diameter, and said conductor defining a conductor diameter smaller than said insulating cover diameter, comprising:

a discrete probe tip portion having a generally cylindrical base and an elongated metal pin extending from said tip portion base; and a coupling portion comprising:

an elongated body portion;

a first set of opposed, bendable arms integrally formed with said body portion for mechanically grasping said insulating cover;

a second set of opposed bendable arms integrally formed with said body portion for electrically and mechanically grasping said inner electrical conductor, said first and second set of arms being in laterally offset relation along said body portion with each other; and a third set of opposed, bendable arms integrally formed with said body portion, said third set of arms spaced from said second set, said second set of arms being disposed between said first and third sets of arms, said third set of arms including interlocking means for interconnecting said third set of arms to form a tubular tip portion receiving receptacle electrically coupled to said first and second set of arms, for electrically and mechanically grasping said probe tip portion, said first set of arms and said body portion defining a first channel for receiving said insulating cover, and said second set of arms and said body portion defining a second channel for receiving said electrical conductor, said second channel including a plurality of strength providing ribs, and said first channel having an internal cross sectional diameter adapted for receiving said insulating cover and said second channel having an internal cross sectional diameter smaller than said first channel diameter and adapted for receiving said electrical conductor, said third set of arms and said body portion defining a third channel for receiving said probe tip portion, said probe tip base being staked within said third channel by inwardly bending said body portion against said probe tip base to form a staking indentation, said body portion including structure defining an aperture communicating with said third channel at said staking indentation to facilitate said inward bending, said third set of arms being swaged on to the cylindrical base of said probe tip portions to form a frustoconical probe tip base crimping portion.

2. The probe contact of claim 1, said first channel being oriented generally perpendicular to said second channel, and said second channel being linearly aligned with said third channel.

* * * * *

UNITED STATES PATENT AND TRADEMARK OFFICE

CERTIFICATE OF CORRECTION

PATENT NO. : 4,596,440

DATED : June 24, 1986

INVENTOR(S) : Grant S. Quam

It is certified that error appears in the above-identified patent and that said Letters Patent is hereby corrected as shown below:

Column 6, line 14, claim 2, delete "oriented generally perpendicular to" and substitute therefor --linearly aligned with--.

Column 6, lines 15-16, claim 2, delete "linearly aligned with" and substitute therefor --oriented generally perpendicular to--.

Signed and Sealed this

Thirtieth Day of December, 1986

*Attest:*

DONALD J. QUIGG

*Attesting Officer*

*Commissioner of Patents and Trademarks*